US009111695B2

(12) United States Patent
Bunk et al.

(10) Patent No.: US 9,111,695 B2
(45) Date of Patent: Aug. 18, 2015

(54) ELECTRICAL SWITCHING DEVICE, ESPECIALLY CIRCUIT BREAKER

(71) Applicants: Thomas Bunk, Sulzbach-Rosenberg (DE); Reinhard Herdegen, Amberg (DE); Siegfried Pirker, Ensdorf (DE)

(72) Inventors: Thomas Bunk, Sulzbach-Rosenberg (DE); Reinhard Herdegen, Amberg (DE); Siegfried Pirker, Ensdorf (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 95 days.

(21) Appl. No.: 13/709,395

(22) Filed: Dec. 10, 2012

(65) Prior Publication Data

US 2013/0199906 A1 Aug. 8, 2013

(30) Foreign Application Priority Data

Feb. 6, 2012 (DE) ..... 10 2012 201 677

(51) Int. Cl.
*H01H 1/64* (2006.01)
*H01H 1/66* (2006.01)
(Continued)

(52) U.S. Cl.
CPC ..... *H01H 9/02* (2013.01); *H01H 71/126* (2013.01); *H01H 71/02* (2013.01)

(58) Field of Classification Search
CPC ..... H01H 1/64; H01H 1/66; H01H 9/02; H01H 9/06; H01H 13/00; H01H 19/04; H01H 19/08; H01H 21/00; H01H 9/04; H01H 3/00; H01H 3/02; H01H 13/04; H01H 13/10; H01H 21/54; H01H 69/00; H01H 71/02; H01H 71/0264; H01H 71/00; H01H 71/054; H01H 71/072; H01H 71/126; H01H 71/128; H01H 71/50; H01H 71/52; H01H 71/521; H01H 71/60; H01H 71/66; H01H 73/00; H01H 73/06; H01H 75/00; H01H 77/00; H01H 2003/00; H01H 2003/161; H01H 2009/00; H01H 2009/20; H01H 2071/02; H01H 2021/016; H01H 2223/00; H01H 2223/044; H01H 2233/05; H01H 2300/046; H01H 2300/048; H01H 2300/05
USPC ..... 200/49, 5 R, 5 A, 16 C, 19.18, 50.01, 200/19.22, 37 R, 48 R, 50.21, 50.23, 50.26, 200/50.24, 51 R
See application file for complete search history.

(56) References Cited

U.S. PATENT DOCUMENTS 4,068,200 A 1/1978 Krueger
4,266,105 A 5/1981 Perkins, Jr.
(Continued)

FOREIGN PATENT DOCUMENTS

DE 69316952 T2 6/1998
EP 1643524 A2 4/2006
WO WO-8903582 A1 4/1989

OTHER PUBLICATIONS

German Search Report dated Oct. 23, 2012.
German Priority Document DE 10 2012 201 677.5.
German Priority Document DE 10 2012 201 677.5, 2012.

*Primary Examiner* — Edwin A. Leon
*Assistant Examiner* — Anthony R. Jimenez
(74) *Attorney, Agent, or Firm* — Harness, Dickey & Pierce, P.L.C.

(57) ABSTRACT

An electrical switching device includes a switching mechanism, a housing element, a cover element and a test button, which is movable between a non-actuated position and an actuated position. When the test button is moved from the non-actuated position into the actuated position, the switching mechanism disconnects at least one moveable contact from at least one fixed contact of the switching mechanism. Further, a blocking element is movable between a first position and a second position, so that the blocking element, when the cover element is closed, is held by the cover element in the first position against a pre-tensioning force in the direction of the second position. Further, when the cover element is opened, the blocking element moves the test button from the non-actuated position into the actuated position.

20 Claims, 4 Drawing Sheets

(51) Int. Cl.

| | |
|---|---|
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |
| ***H01H 21/00*** | (2006.01) |
| ***H01H 71/12*** | (2006.01) |
| *H01H 71/02* | (2006.01) |

(56) References Cited

U.S. PATENT DOCUMENTS

| | | | | |
|---|---|---|---|---|
| 5,457,295 | A | 10/1995 | Tanibe et al. | |
| 6,233,239 | B1 * | 5/2001 | Benayoun et al. | 439/157 |
| 2010/0108484 | A1 * | 5/2010 | Soukup | 200/335 |

* cited by examiner

ELECTRICAL SWITCHING DEVICE, ESPECIALLY CIRCUIT BREAKER

PRIORITY STATEMENT

The present application hereby claims priority under 35 U.S.C. §119 to German patent application number DE 10 2012 201 677.5 filed Feb. 6 2012, the entire contents of which are hereby incorporated herein by reference.

FIELD

At least one embodiment of the invention generally relates to an electrical switching device, especially a circuit breaker, such as a compact circuit breaker, having a switching mechanism for connecting and disconnecting a movable contact from at least one fixed contact of the electrical switching device, a housing element for accommodating the switching mechanism, a cover element for covering internal accessory components and a test button which is able to be moved between a non-actuated position and an actuated position wherein, when the test button is moved from the non-actuated position into the actuated position, the switching mechanism disconnects the at least one movable contact from the at least one fixed contact.

BACKGROUND

Electrical switching devices, such as circuit breakers, have the task of decoupling a number of consumers from a power supply network if a specific fault occurs. The classic fault is the occurrence of a short-circuit current and circuit breakers are conventionally designed to move a switching element in the event of such a short-circuit current and thus to decouple the connection between consumers and network.

SUMMARY

At least one embodiment of the invention relates in particular to circuit breakers or compact circuit breakers respectively in the low voltage area. "Low voltage" typically means voltages up to 1000 volts. With an appropriate mechanical design of the switching disconnection lines, these types of switching devices can also be designed for switching voltages of over 1000 volts, such as up to 6.3 kV for example. In particular these types of electrical switching devices such as low voltage circuit breakers are embodied to interrupt current paths in the event of an overcurrent or in the event of a short circuit. They can be designed as single-pole or multi-pole units, especially three pole units.

At least one embodiment is directed to an electrical switching device, especially a circuit breaker, having a switching mechanism for connecting and disconnecting at least one movable contact from the at least one fixed contact of the electrical switching device, a housing element for accommodating the switching mechanism, a cover element for covering internal accessory components and a test button which is able to be moved between a non-actuated position and an actuated position wherein, when the test button is moved from the non-actuated position into the actuated position, the switching mechanism disconnects the at least one movable contact from the at least one fixed contact. The electrical switching device is also characterized in that a blocking element is disposed movably between a first position and a second position such that the blocking element, with the cover element closed, is held by the cover element in the first position against a pre-tensioning force in the direction of the second position, and that the blocking element is embodied, when the cover element is opened, through its movement into the second position, to move the test button from the non-actuated position into the actuated position.

BRIEF DESCRIPTION OF THE DRAWINGS

The electrical switching device and its developments, as well as their advantages, are explained below with reference to drawings in which, in schematic diagrams in each case.

Elements with the same function and mode of operation are provided with the same reference characters in FIGS. 1 to 6.

DETAILED DESCRIPTION OF THE EXAMPLE EMBODIMENTS

Figure 1:
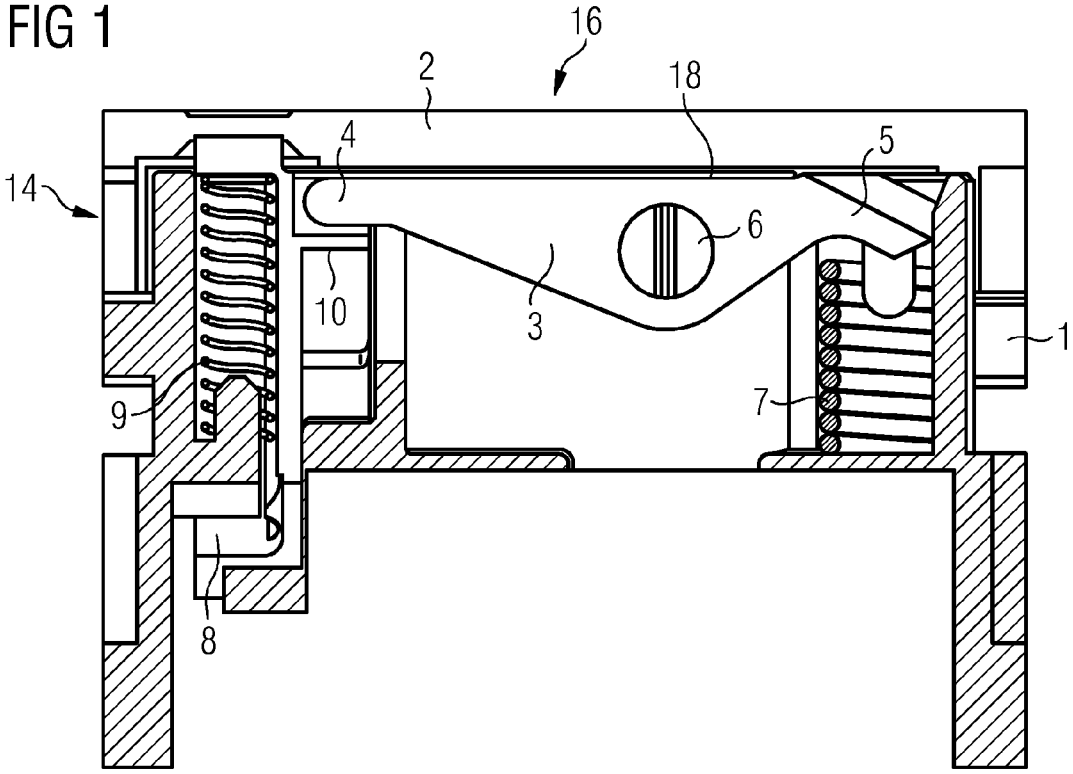
FIG. 1 shows a cross section of a test button and a blocking element of an electrical switching device which is embodied in accordance with an embodiment of the inventive construction principle, wherein the blocking element is located in a first position because the cover element is closed.

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

Electrical switching devices such as circuit breakers are generally known. They have a movable contact at the free end of which a contact piece is disposed. When the switching device is closed this contact piece rests against an opposing contact piece of a fixed contact. The switching device can be switched on and also off manually by means of a handle. The handle is embodied as a pivoting handle which is able to be pivoted from an off position to an on position and vice versa.

In such cases the handle indicates through its respective position whether the switch is switched on or switched off. Disposed within the electrical switching device is a switching mechanism, by which the movable contact can be moved.

Such a switching device also has a tripping element, especially in the form of a tripping shaft, which is able to be bought into effective contact with the switching mechanism for tripping the switching device. The functionality of the electrical switching device can be tested via a test button. The test button in this case is effectively connected to the tripping element. During an actuation of the test button the tripping element can be moved such that it actuates the switching mechanism for separating the movable contact from the fixed contact, in other words for tripping the switching device.

It is not permissible for the compact circuit breaker to be able to be switched on when the cover element, which can especially be an accessory cover, is open. This means that if the handle of the switching device is switched on with an opened cover element or accessory cover, either the handle must be blocked before it reaches the switch-on position or the switching device must trip before the switch-on position is reached.

Therefore a task of at least one embodiment of the present invention is to create an electrical switching device, especially a circuit breaker which ensures in a simple and safe way that the electrical switching device cannot be switched on if a cover element is open.

Further features and details of at least one embodiment of the invention emerge from the subclaims, the description and the drawings.

At least one embodiment is directed to an electrical switching device, especially a circuit breaker, having a switching mechanism for connecting and disconnecting at least one movable contact from the at least one fixed contact of the electrical switching device, a housing element for accommodating the switching mechanism, a cover element for covering internal accessory components and a test button which is able to be moved between a non-actuated position and an actuated position wherein, when the test button is moved from the non-actuated position into the actuated position, the switching mechanism disconnects the at least one movable contact from the at least one fixed contact. The electrical switching device is also characterized in that a blocking element is disposed movably between a first position and a second position such that the blocking element, with the cover element closed, is held by the cover element in the first position against a pre-tensioning force in the direction of the second position, and that the blocking element is embodied, when the cover element is opened, through its movement into the second position, to move the test button from the non-actuated position into the actuated position.

An electrical switching device embodied in such a way makes it possible in a simple and safe manner for the electrical switching device not to be able to be switched on with an open cover element. The blocking element is in this case disposed on the electrical switching device in such a way that, when the cover element is opened, it actuates the test button of the electrical switching device, which in its turn causes the electrical switching device to trip, i.e. causes a disconnection of the at least one movable contact from the at least one fixed contact.

The blocking element ensures that, immediately the cover element of the electrical switching device is opened, the switching device is tripped via the test button, so that no current can flow via the at least one movable contact to the at least one fixed contact. The fact that the blocking element is embodied to move the test button of the electrical switching device from the non-actuated position into the actuated position, when the cover element is opened, ensures a defined tripping of the electrical switching device. In this case the test button of the electrical switching device is connected to the switching mechanism of the electrical switching device such that, when the test button is moved from the non-actuated position into the actuated position, the switching mechanism disconnects the at least one movable contact from the at least one fixed contact of the electrical switching device.

With a closed cover element the blocking element is supported on the inner side of the cover element. In this case the blocking element is held by the cover element in a first position, when the cover element is closed, against a pre-tensioning force in the direction of a second position. This means the pre-tensioning force acting on the blocking element in the first position moves the blocking element into the second position as soon as the cover element is opened. The blocking element is actively connected to the test button of the electrical switching device such that, when the cover element is opened, the movement of the blocking element from the first position into the second position moves the test button from the non-actuated position into the actuated position wherein, with this movement, the at least one movable contact is disconnected from the at least one fixed contact of the electrical switching device.

The fact that the blocking element is connected indirectly via the test button to the switching mechanism of the electrical switching device guarantees that there is an exactly-defined disconnection of the at least one movable contact from the at least one fixed contact of the electrical switching device. Advantageously the test button of the electrical switching device is able to be brought into effective contact with a tripping element, which acts on the switching mechanism such that a disconnection of the contact is made possible. The fact that the test button is able to be bought into direct contact with the switching mechanism or with the tripping element of the switching mechanism guarantees that a tripping of the electrical switching device that is always the same, i.e. a defined disconnection of the at least one movable contact and the at least one fixed contact, is provided.

Were the blocking element to act directly on the switching mechanism or the tripping element of the switching mechanism directly such a defined tripping of the electrical switching device could not be assured. This could especially not be assured since, as a result of tolerances in the size of the blocking element, the housing element and/or the attachment of the blocking element to the electrical switching device, there would be different distances between the blocking element and the switching mechanism or the tripping element of the switching mechanism.

An electrical switching device embodied in this way, especially a circuit breaker, such as a compact circuit breaker, cannot be switched on as a result of the actuation of the test button via the blocking element with the cover element open. This additional function of the electrical switching device can be ensured with few additional components and simple assembly steps. The blocking element necessary for actuating the test button can be simply disposed on a housing element of the electrical switching device such that this is able to be brought into effective contact both with the test button and also with the cover element of the electrical switching device. The cover element of the electrical switching device serves in this case to cover the internal accessory components of the electrical switching device. The switching mechanism of the electrical switching device is at least partly accommodated in a housing element of the electrical switching device. The cover element covers the switching mechanism of the electrical switching device such that the internal accessory components for an operator of the switching device are not accessible.

The blocking element is disposed on the electrical switching device movably between a first position and a second position such that the blocking element, when the cover element is closed, is held by the cover element in the first position against a pre-tensioning force in the direction of the second position. This means that a pre-tensioning force is generated when the cover element is closed, which moves the blocking element from the first position into the second position, as soon as the cover element is opened. When the cover element is opened the pre-tensioning force ensures that the blocking element is moved from the first position into the second position, wherein it comes into effective contact with the test button of the electrical switching device such that the test button is moved from the non-actuated position into the actuated position, in which the test button actuates the switching mechanism directly or indirectly, in order to implement a disconnection of the at least one movable contact from the at least one fixed contact.

The blocking element is disposed movably on the housing element or a housing element respectively of the electrical switching device. Preferably there can be provision with an electrical switching device for the blocking element to be supported rotatably or to allow hinged movement on a support element, especially on a housing element. The support of the blocking element on a support element means that its position within the electrical switching device is defined.

Furthermore the blocking element can easily be supported on the support arm such that this is able to be moved between a first position and a second position. The support element and the blocking element in this case are matched to one another such that the blocking element can be moved by the cover element into the first position against a pre-tensioning force in the direction of the second position. The support element can be a stud or pin projecting on the housing element for example. For securing the blocking element axially on the support element a further housing element of the electrical switching device or for example a securing element, such as a splint, can be provided. Furthermore the support element can have at least one latching element that holds the blocking element axially on the support element.

In accordance with a preferred development of at least one embodiment of the invention there can be provision in an electrical switching device for at least one elastically-sprung element to be provided for embodying the pre-tensioning force. The elastically-sprung element is disposed in this case such that it is tensioned during the closing process of the cover element, so that, while the cover element is closed, the elastically-sprung element exerts a force on the blocking element that moves the element into the second position as soon as the cover element of the electrical switching device is opened.

There can thus be provision with an electrical switching device for the elastically-sprung element to be embodied at least in sections integrally, especially monolithically, with the blocking element. For example a section of the blocking element can be embodied elastically-sprung, wherein the blocking element is disposed on the electrical switching device, especially on the housing element of the electrical switching device, such that when the cover element of the electrical switching device is closed, the elastically-sprung element is pre-tensioned by a pre-bending of the elastically-sprung element in relation to the rest of the blocking element.

Within the sense of at least one embodiment of the invention, integral means that the elastically-sprung element is a part of the blocking element. Especially preferably the elastically-sprung element is manufactured or embodied monolithically with the blocking element. For example the blocking element can be made of plastic or metal. The elastically-sprung element in this case can be embodied by a specific design of the blocking element, for example by a caudal design.

Furthermore, there can be provision in an electrical switching device for the elastically-sprung element, at least in sections, to be embodied as a separate element from the blocking element. Thus for example the blocking element can be embodied as a rigid element to which an elastically-sprung element is attached.

The elastically-sprung element can further be disposed with the other end at a fixed point within the electrical switching device, so that during a movement of the blocking element the elastically-sprung element is pre-tensioned or relaxed respectively. For example the elastically-sprung element embodied as a separate element can be embodied as a tension or compression spring. The elastically-sprung element is not restricted to tension or compression springs. Naturally other elastically-sprung elements, such as screw springs, bending springs, leaf springs or plate springs or elastomer springs can be provided. The elastically-sprung element is disposed in such cases on the blocking element such that this moves the blocking element from the first position into the second position when the cover element is opened.

In accordance with an especially preferred development of at least one embodiment of the invention, there can be provision in an electrical switching device for the blocking element to be embodied as a rocker. In this case the blocking element embodied as a rocker is supported in a central area on the electrical switching device, especially on a support element of the electrical switching device, to allow pivoting movement or rotational movement respectively. The elastically-sprung element can optionally be disposed at the first end of the blocking element embodied as a rocker or at the second end of the blocking element embodied as a rocker. Depending on the direction in which the blocking element is to be moved in order to actuate the test button of the electrical switching device, the elastically-sprung element can be embodied as a tension or as a compression spring.

In at least one embodiment of an inventive electrical switching device, there can further be provision for the test button to have a stop and for the blocking element to have a first end able to be brought into effective contact with the stop for moving the test button from the non-actuated position into the actuated position. In this embodiment the first end of the blocking element is disposed in relation to the stop of the test button such that, when the blocking element is moved from the first position into the second position, the first end of blocking element engages with the stop of the test button in order to move the latter from the non-actuated position into the actuated position. In this case the first end of the blocking element is coupled to the stop of the test button such that, when the test button is moved from the actuated position into the non-actuated position, the blocking element will be moved from its second position back into the first position. The pre-tensioning force which acts on the blocking element is to be overcome here. This is done via the cover element when the latter is closed, i.e. when the element covers at least sections of the switching mechanism or the housing element.

It can be of advantage if there is provision in at least one embodiment of an electrical switching device for the blocking element to have a flat side to rest against the cover element. This ensures that the blocking element, when it rests on the closed cover element, cannot be displaced or twisted.

The test button of the electrical switching device, in at least one embodiment, is disposed on the electrical switching device such that, when the test button is moved from the non-actuated position into the actuated position, the switching mechanism of the electrical switching device disconnects the at least one moving contact of the electrical switching device from the at least one fixed contact of the electrical switching device. Especially preferable is an electrical switching device in which the test button is in effective contact via a tripping element, especially a tripping shaft, with the switching mechanism. This means that when the test button is moved from the non-actuated position into the actuated position, the test button can actuate a tripping element, especially a tripping shaft, of the electrical switching device, which for its part actuates the switching mechanism, especially via a pawl, such that the at least one movable contact is disconnected from the at least one fixed contact of the electrical switching device.

In accordance with a further preferred development of at least one embodiment of the invention, there can be provision in an electrical switching device for the test button to have a spring element that is able to be pre-tensioned when the test button is moved from the non-actuated position into the actuated position. The test button can be embodied such that, after its actuation, it remains in the actuated position. Via the spring element of the test button the test button can for example be moved during a new actuation from the actuated position back into the non-actuated position. It is however also conceivable for the spring element to automatically move the test button, after the actuation, i.e. the movement of the test button from the non-actuated position into the actuated position, back into the non-actuated position. The decisive factor is that during the actuation of the test button, this button actuates the switching mechanism of the electrical switching device in order to make possible a disconnection of the at least one movable contact from the at least one fixed contact. The spring element of the test button can for example be embodied as a compression spring, especially as a coil spring. Here too other forms of spring element are naturally conceivable.

It can be of advantage, in at least one embodiment, for there to be provision with an electrical switching device for the support element to be embodied as a double snap-in hook. A support element embodied in this way makes possible a simple arrangement of the blocking element, especially the blocking element embodied as a rocker, on the support element. The two snap-in hooks are disposed spaced slightly apart so that these can be moved towards one another to receive the blocking element. In the relaxed state the snap-in hooks form a circular outer contour on which the blocking element is rotatably supported. At the same time a support element embodied in this way makes it possible for the blocking element to be fixed in the axial direction to the support element. The snap-in hooks advantageously have an outer latching lug. Such a support element makes it possible in a mechanically simple and favorable manner for the blocking element to be disposed on the support element merely to allow pivoting or rotational movement. The support element is advantageously integrally, especially monolithically, embodied with the housing element of the electrical switching device.

As already previously stated, there can be provision in an electrical switching device for the cover element to be an accessory cover for closing off at least one accessory element compartment of the electrical switching device. Accessory elements can for example be auxiliary tripping devices, tripping indicator switches or the like.

The electrical switching device can be embodied as a circuit breaker. Especially preferably the electric switching device is a compact circuit breaker which is suitable for disconnection of overcurrents and also of short-circuit currents.

FIG. 1 shows a schematic cross-sectional diagram of a test button 8 as well as a blocking element 3 of an electrical switching device 30, which is embodied in accordance with an embodiment of the inventive construction principle. The electrical switching device 30 can especially be embodied as a circuit breaker, especially preferably as a compact circuit breaker. The blocking element 3 in this electrical switching device 30 is embodied as a rocker. In this case the blocking element 3 is supported around a support element 6, which is preferably embodied as a double snap-in hook to allow pivoting or rotational movement respectively.

The first end 4 of the blocking element 3, during a movement of the blocking element 3 with the test button 8, can especially engage with a stop 10 of the test button 8 in order, during a movement of the blocking element 3, to move the test button 8 from a non-actuated position into the actuated position. Attached to the second end 5 of the blocking element 3 is an elastically-sprung element, here in the form of a coil compression spring. The second end of the elastically-sprung element is fixed to the electrical switching device 30, especially to a housing element 1 of the electrical switching device 30. In FIG. 1 the blocking element 3 is located in a first position 16. In this first position 16 the blocking element 3 is held by the closed cover element 2 of the electrical switching device 30 against a pre-tensioning force in the direction of the second position 17 of the blocking element 3. The pre-tensioning force is exerted on the blocking element 3 by the elastically-sprung element 7.

FIG. 1 shows the blocking element 3 in the first position 16, in which it is held by the cover element 2 against the pre-tensioning force of the elastically-sprung element 7. In this case the blocking element 3, especially a flat side 18 of the blocking element 3, rests on the inner side of the cover element 2 against the element. The blocking element 3 is securely held hereby in the first position 16. The test button 8 is located in the non-actuated position 14, in which the test button 8 is not connected to the switching mechanism 12 of the electrical switching device 30, or is connected in such a way, see FIGS. 3 and 4, that the device cannot enable any disconnection of the at least one movable contact from the at least one fixed contact of the electrical switching device. The test button 8 has a spring element 9, here in the form of a coil compression spring, which is embodied to reset the test button 8 from the actuated position 15 into the non-actuated position 14.

Figure 2:
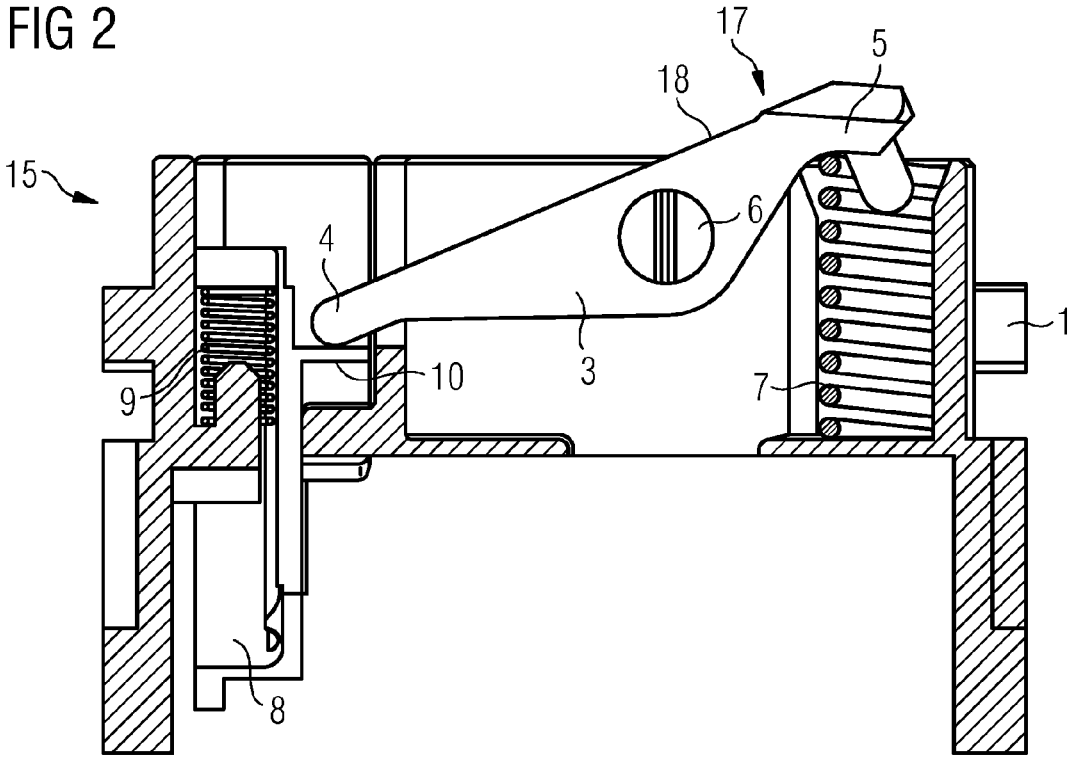
FIG. 2 shows the test button and the blocking element of the electrical switching device in accordance with FIG. 1, wherein the blocking element is located in the second position because the cover element is open.

In FIG. 2 the test button 8 and the blocking element 3 are shown with the cover element 2 opened. The cover element 2 is therefore not shown in this figure. The fact that the cover element 2 does not hold the blocking element 3 in the first position 16 means that the blocking element 3, because of the pre-tensioning force of the elastically-sprung element 7, has been pivoted from the first position 16, shown in FIG. 1, into the second position 17. The first end 4 of the blocking element 3, during the movement of the blocking element 3 into the second position 17, has moved the test button 8 from the non-actuated position 14 into the actuated position 15.

In this case the blocking element 3 has moved the test button 8, against the spring force of the spring element 9 of the test button 8, into the actuated position 15. During the movement of the test button 8 from the non-actuated position 14 into the actuated position 15, the test button 8 has moved into effective contact with the switching mechanism 12 of the electrical switching device 30 such that the at least one movable contact of the electrical switching device 30 has been disconnected from the at least one fixed contact of the electrical switching device 30. Especially preferably the test button 8 acts during the movement from the non-actuated position 14 into the actuated position 15 on a tripping element 13, especially a tripping shaft, which in its turn actuates the switching mechanism 12 of the electrical switching device 30, so that the contacts of the electrical switching device are disconnected from one another. The tripping element 13 of an electrical switching device 30 is shown in FIGS. 3 and 4.

Figure 3:
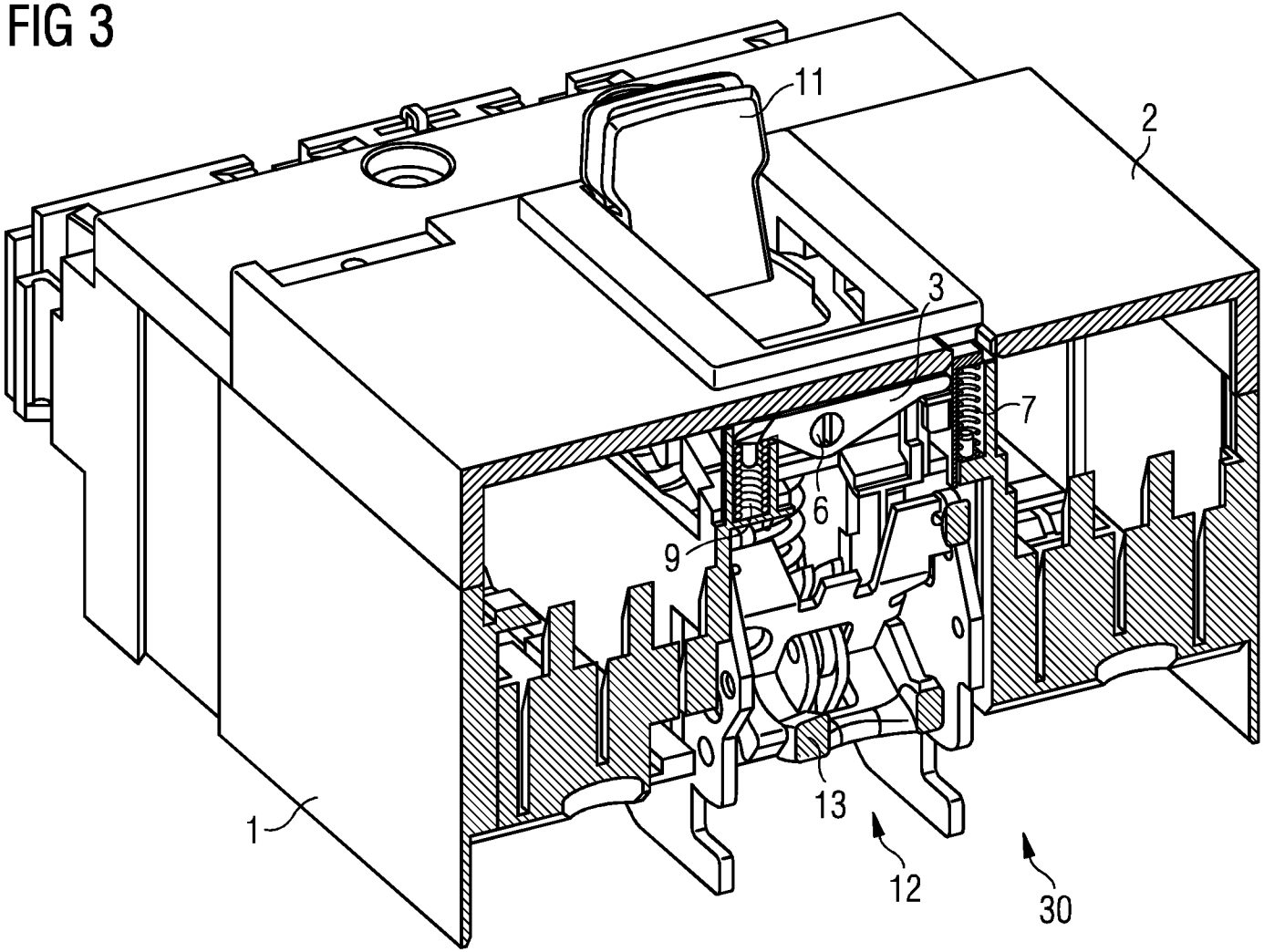
FIG. 3 shows a perspective view of an electrical switching device with closed cover element which is embodied in accordance with an embodiment of the inventive construction principle.

FIG. 3 shows an electrical switching device having a housing element 1 and a cover element 2, which is shown in the closed state. In this state the cover element 2 presses the blocking element 3 from the second position 17 against the pre-tensioning force of the elastically-sprung element 7 into the first position 16. The test button 8 is located in this position of the blocking element 3 in the non-actuated position 14.

Figure 4:
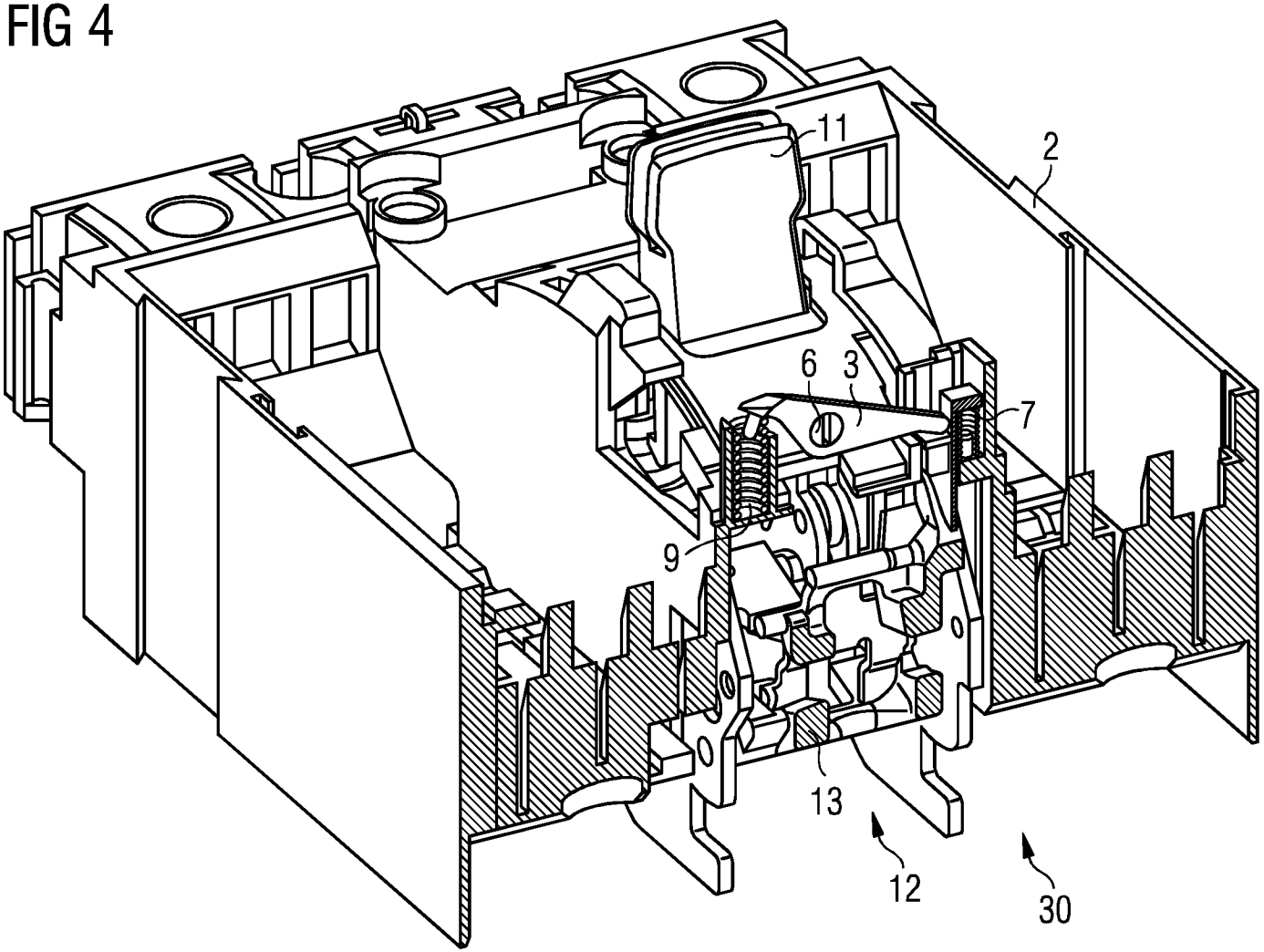
FIG. 4 shows a perspective view of the electrical switching device in accordance with FIG. 3 without cover element.

In FIG. 4 the cover element 2 is opened or no longer shown in this figure, so that as a result of the absence of the cover element 2, the elastically-sprung element 7 moves the blocking element 3 embodied as a rocker around the support element 6 from the first position 16 into the second position 17. With the movement of the cover element 2 from the first position 16 into the second position 17, the blocking element 3 moves the test button 8 from the non-actuated position 14 into the actuated position 15. When this occurs the test button 8 actuates the tripping element 13 of the electrical switching device 30, which in its turn actuates the switching mechanism 12, especially a switching pawl of the switching mechanism 12, so that via the switching mechanism 12, the at least one movable contact is disconnected from the at least one fixed contact of the electrical switching device 30.

Figure 5:
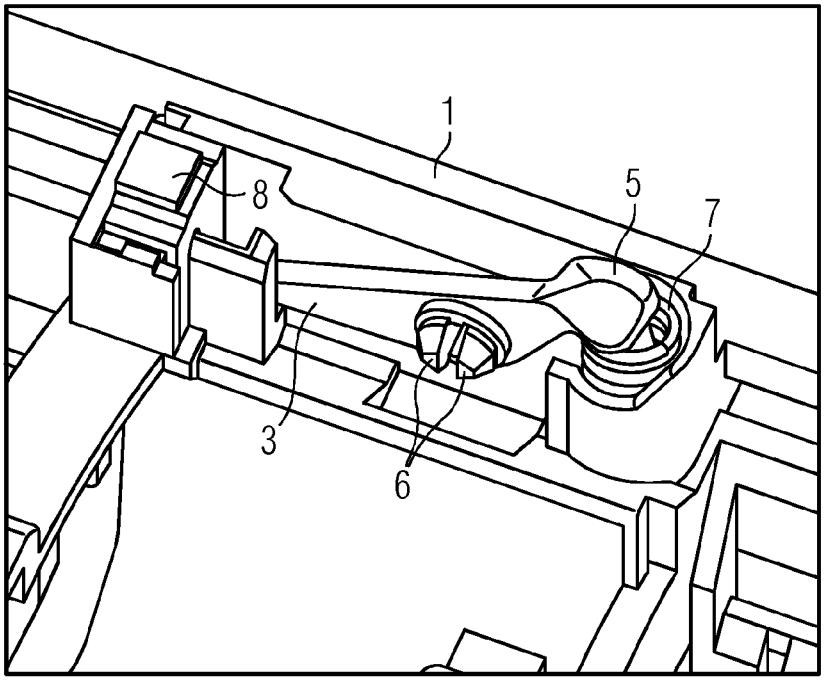
FIG. 5 shows a perspective view of the area of the electrical switching device on which the test button and the blocking element are disposed.
Figure 6:
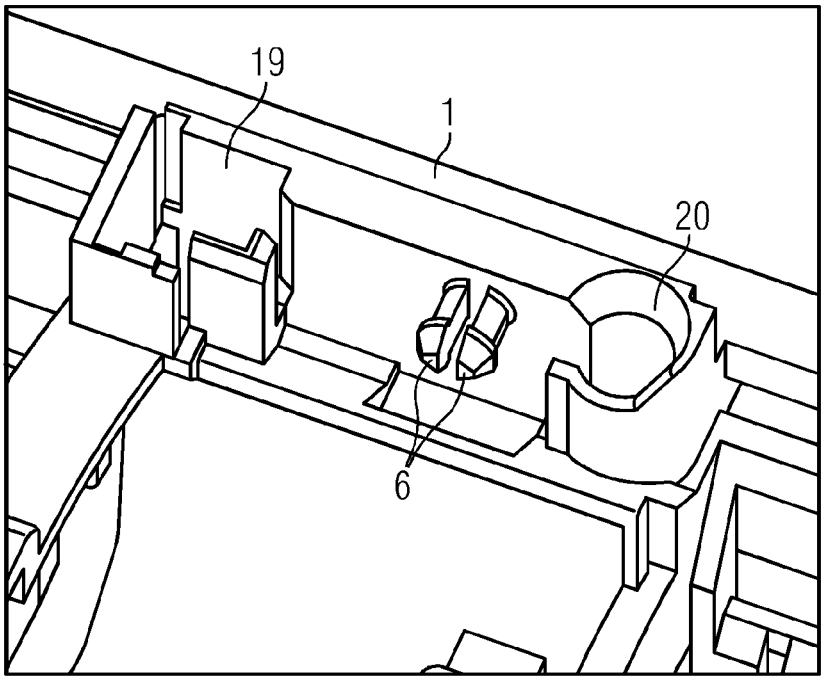
FIG. 6 shows the area of the electrical switching device in accordance with FIG. 5 and shows the guides for the test button and the blocking element.

FIG. 5 shows a schematic diagram in a perspective view of the arrangement of a test button 8 and the blocking element 3 embodied as a rocker on the electrical switching device 30, especially on the housing element 1 of the electrical switching device 30, which is especially embodied as a compact circuit breaker. The test button 8 is retained to allow linear movement in a guide 19, visible in FIG. 6. The blocking element 3 embodied as a rocker is supported to allow rotational or pivoting movement on the support element 6 which is embodied as a double snap-in hook. The support element 6 is an integral component of the housing element 1 of the electrical switching device 30. In particular the support element 6 or the double snap-in hooks 6 are manufactured monolithically with the housing element 1. The support element 6 embodied as a double snap-in hook can especially be seen in FIG. 6. Attached to the second end 5 of the blocking element 3 is an elastically-sprung element 7. The elastically-sprung element 7 is held in a guide 20 in the housing element 1. The free end of the elastically-sprung element 7 is fixed to the housing element 1. When the cover element 2 is closed, the cover element 2 initially engages with the second end 5 of the blocking element 3 and in doing so compresses the elastically-sprung element 7 held in the guide 20.

After the opening of the cover element 2 and the associated movement of the test button 8 from the non-actuated position 14 into the actuated position 15, it is ensured that by the actuation of the switching mechanism 12 the at least one movable contact has been disconnected from the at least one fixed contact of the electrical switching device 30. A pivoting of the pivot lever 11 of the electrical switching device 30 from an OFF position into an ON position would not lead to the electrical switching device 30 being switched on. This means that an electrical switching device or a compact circuit breaker 30 embodied in this way could be switched on with an opened cover element 2 which is especially an accessory cover.

The example embodiment or each example embodiment should not be understood as a restriction of the invention. Rather, numerous variations and modifications are possible in the context of the present disclosure, in particular those variants and combinations which can be inferred by the person skilled in the art with regard to achieving the object for example by combination or modification of individual features or elements or method steps that are described in connection with the general or specific part of the description and are contained in the claims and/or the drawings, and, by way of combinable features, lead to a new subject matter or to new method steps or sequences of method steps, including insofar as they concern production, testing and operating methods.

References back that are used in dependent claims indicate the further embodiment of the subject matter of the main claim by way of the features of the respective dependent claim; they should not be understood as dispensing with obtaining independent protection of the subject matter for the combinations of features in the referred-back dependent claims.

Furthermore, with regard to interpreting the claims, where a feature is concretized in more specific detail in a subordinate claim, it should be assumed that such a restriction is not present in the respective preceding claims.

Since the subject matter of the dependent claims in relation to the prior art on the priority date may form separate and independent inventions, the applicant reserves the right to make them the subject matter of independent claims or divisional declarations. They may furthermore also contain independent inventions which have a configuration that is independent of the subject matters of the preceding dependent claims.

Further, elements and/or features of different example embodiments may be combined with each other and/or substituted for each other within the scope of this disclosure and appended claims.

Still further, any one of the above-described and other example features of the present invention may be embodied in the form of an apparatus, method, system, computer program, tangible computer readable medium and tangible computer program product. For example, of the aforementioned methods may be embodied in the form of a system or device, including, but not limited to, any of the structure for performing the methodology illustrated in the drawings.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

LIST OF REFERENCE CHARACTERS

1 Housing element
2 Cover element
3 Blocking element/rocker
4 First end of the blocking element
5 Second end of the blocking element
6 Support element
7 Elastically-sprung element
8 Test button
9 Spring element
10 Stop
11 Pivot lever
12 Switching mechanism
13 Tripping element
14 OFF position
15 ON position
16 First position of the blocking element
17 Second position of the blocking element
18 Flat side of the blocking element
19 Guide for test button
20 Guide for elastically-sprung element
30 Electrical switching device

What is claimed is:

1. An electrical switching device, comprising:

a switching mechanism, configured to connect and disconnect at least one movable contact and at least one fixed contact of the electrical switching device;

a housing element, configured to accommodate the switching mechanism;

a cover element disposable on the housing element and configured to cover internal accessory components and the switching mechanism, the cover element including an opening configured to accommodate a pivot lever of the electrical switching device;

a test button, movable between a non-actuated position and an actuated position wherein, during the movement of the test button from the non-actuated position into the actuated position, the switching mechanism is configured to disconnect the at least one movable contact from the at least one fixed contact; and a blocking element, moveably disposed between a first position and a second position and configured such that the blocking element, when the cover element is closed, is held by the cover element in the first position against a pre-tensioning force in a direction of the second position and configured such that the blocking element is embodied, when the cover element is opened, through the movement into the second position, to move the test button from the non-actuated position into the actuated position, wherein at least one elastically-sprung element is provided to embody the pre-tensioning force.

2. The electrical switching device of claim 1, wherein the blocking element is supported on a support element to allow rotational or pivoting movement.

3. The electrical switching device of claim 1, wherein the elastically-sprung element is embodied, at least in sections, integrally with the blocking element.

4. The electrical switching device of claim 1, wherein the elastically-sprung element is embodied, at least in some sections, as a separate element from the blocking element.

5. The electrical switching device of claim 4, wherein the separate element is embodied as a tension or compression spring.

6. The electrical switching device of claim 1, wherein the blocking element is embodied as a rocker.

7. The electrical switching device of claim 1, wherein the test button includes a stop and wherein the blocking element includes a first end which is able to be brought into effective contact with the stop for moving the test button from the non-actuated position into the actuated position.

8. The electrical switching device of claim 1, wherein the blocking element includes a flat side for resting against the cover element.

9. The electrical switching device of claim 1, wherein the test button is in effective contact with the switching mechanism via a tripping element.

10. The electrical switching device of claim 1, wherein the test button includes a spring element, pre-tensionable during the movement of the test button from the non-actuated position into the actuated position.

11. The electrical switching device of claim 2, wherein the support element is embodied as a double snap-in hook.

12. The electrical switching device of claim 1, wherein the cover element is an accessory cover for closing off at least a compartment for accommodating accessory elements of the electrical switching device.

13. The electrical switching device of claim 1, wherein the electrical switching device is a circuit breaker.

14. The electrical switching device of claim 1, wherein the electrical switching device is a compact circuit breaker.

15. The electrical switching device of claim 2, wherein the blocking element is supported on the housing element to allow rotational or pivoting movement.

16. The electrical switching device of claim 3, wherein the elastically-sprung element is embodied, at least in some sections, as a separate element from the blocking element.

17. The electrical switching device of claim 16, wherein the separate element is embodied as a tension or compression spring.

18. The electrical switching device of claim 9, wherein the tripping element is a tripping shaft.

19. The electrical switching device of claim 1, wherein the test button includes a stop and a spring element, the spring element being pre-tensionable during the movement of the test button from the non-actuated position into the actuated position, the blocking element includes a first end which is able to be brought into effective contact with the stop for moving the test button from the non-actuated position into the actuated position, and the blocking element includes a second end in contact with the at least one elastically-sprung element.

20. An electrical switching device, comprising:

a switching mechanism, configured to connect and disconnect at least one movable contact and at least one fixed contact of the electrical switching device;

a housing element, configured to accommodate the switching mechanism;

a cover element, configured to cover internal accessory components;

a test button, movable between a non-actuated position and an actuated position wherein, during the movement of the test button from the non-actuated position into the actuated position, the switching mechanism is configured to disconnect the at least one movable contact from the at least one fixed contact; and a blocking element, moveably disposed between a first position and a second position and configured such that the blocking element, when the cover element is closed, is held by the cover element the first position against a pre-tensioning force in a direction of the second position and configured such that the blocking element is embodied, when the cover element is opened, through the movement into the second position, to move the test button from the non-actuated position into the actuated position, wherein at least one elastically-sprung element is provided to embody the pre-tensioning force, wherein the test button includes a spring element, and the blocking element is configured to compress one of the spring element and the elastically-sprung element and decompress the other one of the spring element and the at least one elastically-sprung element based on whether the cover element is open or closed.

* * * * *